US005107594A

United States Patent [19]

Ferreras

[11] Patent Number: 5,107,594

[45] Date of Patent: Apr. 28, 1992

[54] PILING CUTTING TOOL

[76] Inventor: Julian Ferreras, 5125 Herman St., Barrow, Ak. 99723

[21] Appl. No.: 753,730

[22] Filed: Sep. 3, 1991

[51] Int. Cl.[5] ..... B27B 17/00; B27B 27/08

[52] U.S. Cl. ..... 30/372; 83/745

[58] Field of Search ..... 30/372, 166.3, 383; 83/743, 745, 574, 794, 796–798; 269/1

[56] References Cited

U.S. PATENT DOCUMENTS 4,854,206 8/1989 Wilfong ..... 83/745

*Primary Examiner*—Douglas D. Watts

*Attorney, Agent, or Firm*—Cassidy, Vance & Tarleton

[57] ABSTRACT

A piling cutting tool (10) comprising a piling cutting jig (12) and chain saw (14) engaged therewith. The jig (12) includes a rectangular frame (38) having levels (94) and (96) on the top wall (48) thereof. A receiving tube (58) is attached to the frame (38) and sized and shaped to receive an adapter shaft (84) attached to the chain saw (14). The height of the chain saw (14) is adjusted by a rod (70) and locked into the desired position by locking lever (74). The shaft (84) rotates about the longitudinal axis of the bore (68) to swing the cutting chain (30) through a cutting arc to thereby make a horizontally level cut across the piling (54).

7 Claims, 2 Drawing Sheets

PILING CUTTING TOOL

TECHNICAL FIELD

The present invention pertains to piling cutting tools and, more particularly, to a chain saw jig for mounting a chain saw on a piling projecting out of the ground to achieve a horizontally level transverse cutting of the piling.

BACKGROUND OF THE INVENTION

In many areas around the world, houses, buildings, and other structures must be supported above the earth for stability and safety. Pilings, typically comprising a heavy beam of timber, are driven into the earth as a foundation or support for these structures. In most cases, these pilings are formed of timber beams having a substantially square cross-sectional shape. After the pilings are driven into the earth, they are cut to the appropriate height. It is critical that these pilings be cut to have a horizontally level top surface.

The preferred tool for cutting pilings is the portable chain saw. One disadvantage in using the hand-held portable chain saw is the difficulty the operator has in making a quick, level, and accurate cut. Consequently, it is desirable to mechanically support the chain saw as it is cutting the piling.

While a number of devices have been developed for supporting a chain saw on a work piece, they fall short of meeting the needs described above with respect to cutting an upright piling. More particularly, U.S. Pat. No. 4,726,274 discloses a mitering device for anchoring a chain saw to a horizontal timber. While this device is suitable for a horizontal timber, it fails to provide adequate support for a chain saw mounted in a vertical position on a piling because the frame only grasps two corners of the timber and does not provide for adjustment in the position of the chain saw cutting blade longitudinally along the timber for precise alignment with the cutting level. In addition, the device fails to provide any method for determining whether the chain saw is horizontally level prior to cutting.

U.S. Pat. No. 4,854,206 is directed to an adjustable tool support device for a chain saw. This device also is designed for use in cutting horizontally positioned timbers. In this regard, it fails to provide an easy method for adjusting the chain saw along the longitudinal axis of the timber, especially when the timber is in an upright position. Furthermore, the chain saw is not easily and quickly detachable from the supporting device. In addition, the device is overly complex and cumbersome because it is designed to position the chain saw about three different axes, which is not necessary to provide a horizontally level cut in an upright timber or piling.

Finally, U.S. Pat. No. 2,608,220 discloses a frame having a power saw attached thereto for mounting to an upright pole. This device discloses no method for allowing fine adjustment in the position of the power saw vertically along the longitudinal axis of the pole. In addition, there is no provision for attachment of a power chain saw. Rather, this device is directed to an underwater circular saw.

Because upright pilings require firm attachment of the chain saw while permitting fine adjustment in the position of the chain saw, there is a need for a piling cutting jig that enables the attachment of the jig to a piling that may project only several inches above the ground and permits fine adjustment in the vertical positioning of the chain saw to achieve the proper height. Finally, there is also a need for a means to horizontally level the chain saw so that even if the pilings were projecting out of the ground at an angle, the cut across the top of the piling would be horizontally level. Furthermore, because a number of pilings must be cut at one time, it is important that the chain saw be easily removable from the jig to allow repositioning of the jig on a new piling.

SUMMARY OF THE INVENTION

The present invention is directed to a tool for cutting a piling transversely across the longitudinal axis of the piling. The tool comprises a portable chain saw, a frame sized and shaped to be placed over the piling, a receiving sleeve or guide tube attached to the frame having a longitudinal axial bore oriented perpendicular to the plane of the frame, and an adapter attached to the chain saw and formed to be slidably engaged with the receiving means to enable selective positioning of the adapter within the receiving means both along the longitudinal axis and rotationally about the longitudinal axis.

In accordance with another aspect of the present invention, at least two or more levels are provided on the frame to enable horizontal leveling of the frame. Preferably, these levels are positioned along two perpendicular horizontal axes.

In accordance with another aspect of the present invention, the adapter is selectively positioned within the receiving sleeve by means of a threaded rod engaged with the open bottom of the receiving tube. Preferably, the threaded rod is held in position by a locking nut threadably engaged with the rod and positioned adjacent the bottom of the receiving sleeve.

In accordance with still yet another aspect of the present invention, an indicator is provided that is attached to the chain saw to enable the user to accurately position the chain saw with respect to a predetermined position to be cut on the piling.

As will be readily appreciated from the foregoing description, the present invention enables any chain saw to be easily adapted for use with the frame by means of the adapter. The adapter easily slides into the receiving sleeve once the frame is positioned on the piling. Horizontal leveling of the frame on the piling is facilitated by the two levels to ensure a horizontally level cut on the piling. The frame can be easily and quickly moved to another piling, facilitating the rapid cutting of multiple pilings.

BRIEF DESCRIPTION OF THE DRAWINGS

The foregoing and other features and advantages of the present invention will be more readily appreciated as the same becomes better understood from the detailed description when taken in conjunction with the accompanying drawings, wherein.

DETAILED DESCRIPTION OF THE INVENTION

Figure 1:
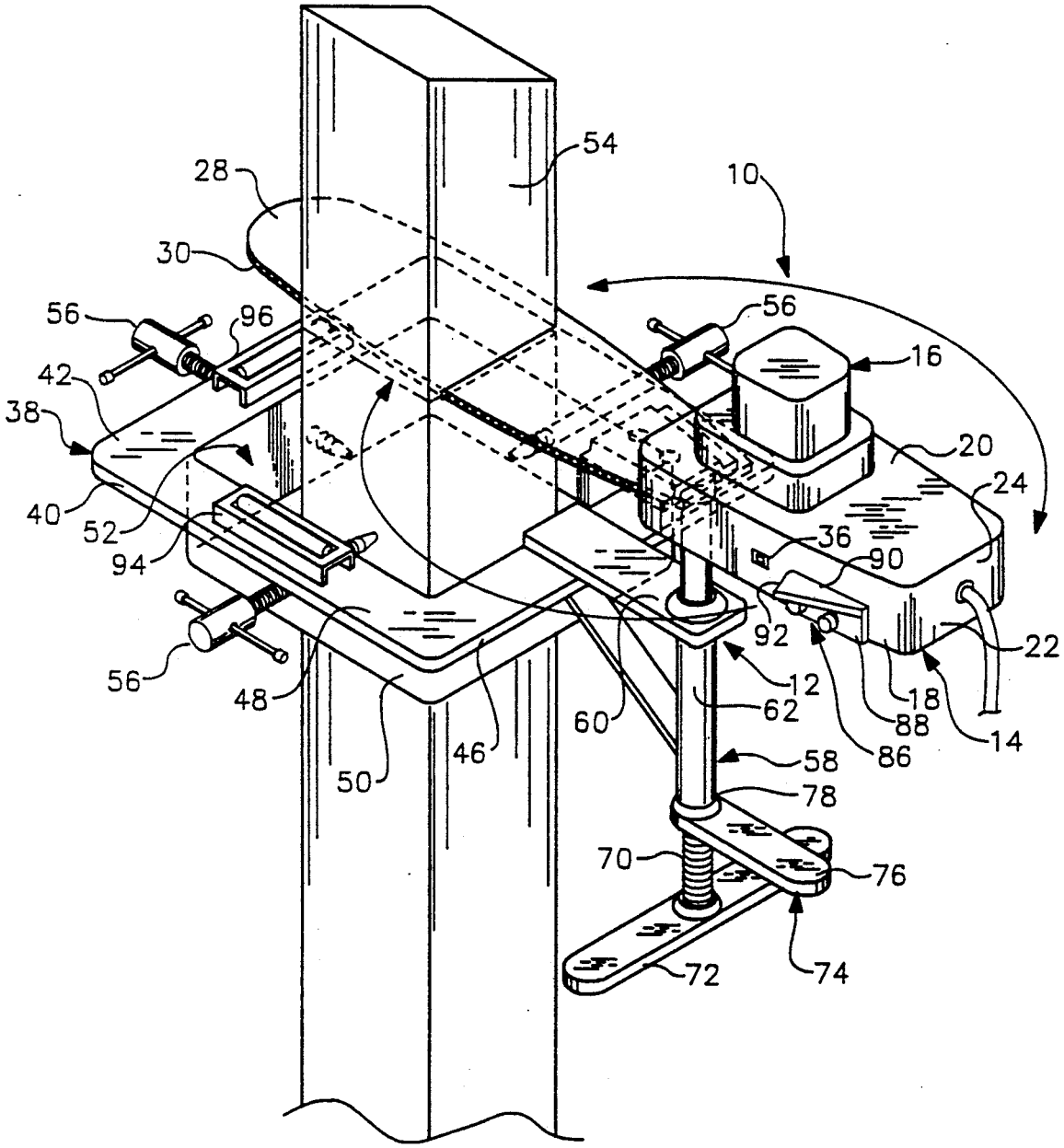
FIG. 1 is an isometric view of the piling cutting tool formed in accordance with the present invention.

Referring initially to FIG. 1, illustrated therein is a piling cutting tool 10 comprised of the piling cutting jig 12 and a chain saw 14. Turning briefly to the chain saw 14, since the chain saw 14 is of a conventional design and readily commercially available, it will not be described in detail herein. Briefly, the chain saw 14 comprises a motor housing 16 having a top 18, a pair of opposing sides 20 and 22, a back 24, and a front 26. The chain saw 14 depicted herein is powered by an electric motor (not shown) that is contained within the motor housing 16. A guide bar 28 comprising an essentially planar-shaped elongate rigid member having a cutting chain 30 movably mounted around the periphery thereof is attached to the front 26. The cutting chain 30 is driven by the electric motor in the motor housing 16.

Front and rear handles (not shown) may be attached to the motor housing 16. An on-off switch 36 controls operation of the chain saw motor. It is to be understood, however, that the present invention is designed to be used with both gasoline and electric-powered chain saws, and the electric chain saw 14 described herein is used merely for purposes of illustration.

Turning now to the piling cutting jig 12, the jig 12 comprises a rectangular frame 38 formed from four side rails 40, 42, 44, and 46. Each side rail 40, 42, 44, and 46 as depicted herein is formed of angle iron having a substantially flat top wall 48 and a perpendicular sidewall 50 projecting from the top wall 48 at substantially a right angle. Each of the side rails 40, 42, 44, and 46 are attached together at substantially a right angle to define a square-shaped opening 52 that is further defined by the sidewalls 50. The opening 52 is thus sized and shaped to be slidably received over a piling 54 (shown in FIG. 1) that is formed of timber to have a substantially square cross-sectional shape. However, it is to be understood that timbers having other cross-sectional shapes may be used, in which case the opening 52 would be shaped accordingly. Further, the square-shaped opening 52 depicted herein may be used on pilings having a circular cross-sectional shape.

To enable attachment of the frame 38 to the piling 54, threaded clamps 56 are threadably received in each sidewall 50 of the side rails 40, 42, and 44. The other side rail 46 does not have a clamp. Rather, a pair of spikes 47 protrude into the opening 52 from side rail 46 to project into and grip the piling 54. The clamps 56 are threaded into the sidewalls 50 to bear against the piling 54 received in the opening 52, thus rigidly affixing the rectangular frame 38 to the piling 54.

Affixed to the outside of side rail 46 is a receiving tube 58. A bracket 60 projects outward from the side rail 46 and is attached to the receiving tube 58 to hold the receiving tube 58 in spaced relationship to the rectangular frame 38.

Figure 2:
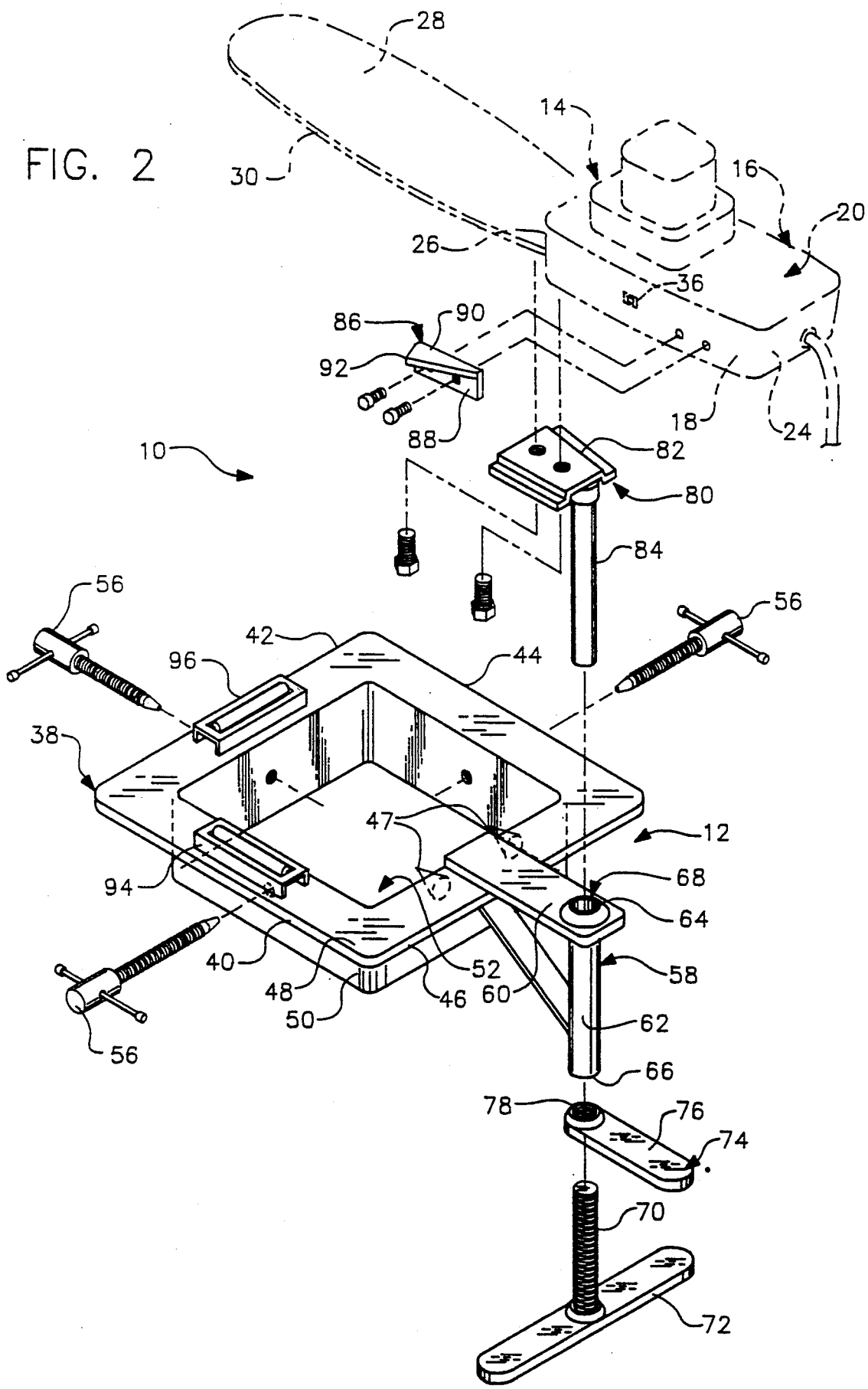
FIG. 2 is an exploded view of the piling cutting tool of FIG. 1.

As shown more clearly in FIG. 2, the receiving tube 58 comprises a cylindrical sleeve 62 having an open top 64 and open bottom 66 that communicate with a longitudinal axial bore 68. The bottom 66 is internally threaded such that an externally threaded rod 70 is threadably engaged therewith. The rod 70 includes a T-shaped handle 72 that facilitates turning of the rod 70 to cause the rod 70 to move into and out of the bore 68 of the receiving tube 58. A locking lever 74 comprising a handle 76 and an internally threaded opening 78 is threadably engaged with the rod 70 and is positioned adjacent the open bottom 66. Moving the locking lever 74 up the rod 70 to bear against the open bottom 66 will lock the rod 70 in position and prevent turning of the rod 70. More particularly, the locking lever 74 performs as a "jam nut" to prevent turning of the rod 70.

An adapter 80 is provided to enable engagement of the chain saw 14 with the piling cutting jig 12. More particularly, the adapter 80 comprises a bracket 82 sized and shaped to be attached to the guide bar 28 of the chain saw 14 and a shaft 84 oriented perpendicular to and projecting outward from the bracket 82. The shaft 84 is sized and shaped to be slidably received within the longitudinal axial bore 68 of the receiving tube 58. With the adapter 80 mounted to the chain saw 14 and engaged with the receiving tube 58 and with the rectangular frame 38 affixed to an upright piling 54, the guide bar 28 and cutting chain 30 will be oriented in a horizontal plane. The shaft 84 rotates in the longitudinal axial bore 68 to enable a user to move the cutting chain 30 into and out of cutting engagement with the piling 54. Adjustment in the position of the chain saw 14 along the longitudinal axis of the piling 54 to adjust the cutting height of the chain saw 14 is accomplished by turning the rod 70 to cause the rod 70 to move up and down the bore 68. The shaft 84 of the adapter 80 bears against the top of the rod 70 to thereby cause the chain saw 14 to move up and down in the receiving tube 58. Once the correct height is selected, the locking lever 74 is rotated into engagement with the bottom 66 of the receiving tube 58 to hold the rod 70 in place.

To facilitate alignment of the guide bar 28 and cutting chain 30 with a predetermined position on the piling, i.e., the desired location of the cut, an elevation index 86 is provided on the top 18 of the chain saw 14. The index 86 comprises a bracket having a first sidewall 88 attached to the chain saw 14 and a second sidewall 90 projecting outward from the first sidewall 88. The second sidewall 90 has a tip 92 that is in alignment with the plane of the guide bar 28. Thus, when the chain saw 14 is mounted in the piling cutting jig 12, the tip 92 of the index 86 can be swung adjacent the piling 54 to indicate the current position of the cutting chain 30.

To facilitate a level cut in the piling 54, a pair of levels 94 and 96 are mounted on the top wall 48 of two adjacent side rails 40 and 42. When so mounted, the levels 94 and 96 will lie in the same horizontal plane along two perpendicular axes. With these levels, an operator can quickly adjust the position of the frame 38 on the piling 54 to ensure that any cut made in the piling 54 will be horizontally level.

The operation of the piling cutting tool 10 will now be described in conjunction with FIG. 1. Initially, the piling 54 will be installed in the ground in a vertical position, i.e., so that the longitudinal axis of the piling is substantially vertical. A mark is made on the piling where the horizontal cut is to be made. The piling is then cut by hand approximately three inches above the desired level to remove excess timber. This prevents excessive weight from bearing down on the saw during the final cut.

The piling cutting jig 12 is then brought into position over the piling and the rectangular frame 38 is slid over the piling. The clamps 56 are lightly tightened and the frame 38 is positioned until both levels 94 and 96 indicate that the frame 38 is in a horizontally level position. The clamps 56 are then further tightened to secure the jig 12 into position on the piling.

The adapter 80, having previously been attached to the chain saw 14, is then brought to the jig 12 and the adapter shaft 84 is slid into the bore 68 at the top 64 of the receiving tube 58. The index 86 is swung into position adjacent the piling 54 such that the tip 92 is clearly visible. The height of the chain saw 14 is then adjusted with the rod 70 until the index tip 92 indicates alignment with the desired level to be cut on the piling 54. The locking lever 74 is turned and tightened to lock the rod 70, and thus the chain saw 14, at the desired height.

The chain saw 14 is then energized and the cutting chain 30 is swung into engagement with the piling 54 to make a horizontally level cut. The cut is made without any burrs or other bumps or obstructions because of the smooth guidance provided by the shaft 84 in the receiving tube 58. Once the cut is made, the chain saw 14 is removed from the jig 12, and the jig 12 is then removed from the piling 54.

While a preferred embodiment of the invention has been illustrated and described, it is to be understood that various changes may be made therein without departing from the spirit and scope of the invention. For instance, the adapter 80 may be constructed to be attached to any chain saw, gas powered or electric powered. Consequently, the scope of the invention is to be limited only by the claims that follow.

The embodiments of the invention in which an exclusive property or privilege is claimed are defined as follows:

1. A piling cutting tool for transversely cutting elongate pilings, the tool comprising:

a portable chain saw;

means for affixing said chain saw to the piling so that said chain saw will transversely cut the piling;

means for mounting said chain saw on said affixing means, said mounting means comprising an adapting means attached to said chain saw and a receiving means attached to said affixing means for slidably receiving said adapting means, such that said adapting means is rotatable about a receiving axis that is parallel to the longitudinal axis of the piling and is movable along said receiving axis to enable selective positioning of said adapting means along the elongate piling;

means for indicating the position of said chain saw with respect to the piling to enable precise alignment of said chain saw with a predetermined position to be cut on the piling; and means associated with said affixing means for indicating horizontally level positioning of said affixing means about two horizontally perpendicular axes when said affixing means is affixed to the piling.

2. A tool for making a horizontally level transverse cut in a vertical piling protruding from the ground, the piling being formed of wood into an elongate shape having a longitudinal axis, the tool comprising:

a portable chain saw;

a frame for mounting said portable chain saw on the piling such that said portable chain saw will make a cut in a plane substantially orthogonal to the longitudinal axis of the piling;

an adapter configured for removable attachment to said chain saw;

a receiving member attached to said frame, said receiving member having a longitudinal axial bore that is formed to be parallel to the longitudinal axis of the piling when said frame is mounted thereon in a horizontally level position, said receiving member being further sized and shaped to receive said adapter in slidable engagement to enable selective positioning of said adapter in said receiving member along the longitudinal axis of the piling and rotation of said adapter in said receiving member; and a rod threadably received in said receiving member for selectively positioning said adapter along the longitudinal axis of the piling.

3. The tool of claim 2, further comprising a locking member for holding said rod in position in said receiving member.

4. The tool of claim 3, further comprising means for horizontally leveling said frame, said horizontally leveling means comprising a pair of levels oriented along perpendicular horizontal axes on said frame for horizontally leveling said frame on the piling.

5. The tool of claim 4, further comprising an indicator mounted on said chain saw for enabling precise alignment of a cutting chain on said chain saw with a predetermined cutting position on the piling.

6. A jig for mounting a chain saw on an upright elongate wooden piling having a substantially square cross-sectional shape, the jig comprising:

a frame having a square quadrilateral shape formed from four equal perpendicular sides that define a square-shaped opening sized to be slidably received over the piling;

a plurality of clamps threadably engaged with said frame for engagement with the piling to hold said frame to the piling;

a tubular sleeve attached to said frame, said tubular sleeve having an open top and an open bottom that define a longitudinal axial bore that is positioned perpendicular to the plane of said frame;

an adapter having a base for attachment to the chain saw and a shaft projecting from said base, said shaft being slidably received within said sleeve for longitudinal and rotational movement therein;

a rod threadably engaged with the open bottom of said tubular sleeve for selectively positioning said adapter shaft longitudinally in said tubular sleeve; and means for locking said rod in position in said tubular sleeve.

7. The jig of claim 6, further comprising a pair of levels mounted on said frame and oriented along perpendicular horizontal axes of said frame for horizontally leveling said frame on the piling.

* * * * *